US007020300B1

(12) United States Patent
Villaverde

(10) Patent No.: US 7,020,300 B1
(45) Date of Patent: Mar. 28, 2006

(54) HEADSET WITH RESILIENTLY DEFLECTABLE BOOM

(75) Inventor: Marcial Villaverde, Mt. Prospect, IL (US)

(73) Assignee: Fellowes, Inc., Itasca, IL (US)

( * ) Notice: Subject to any disclaimer, the term of this patent is extended or adjusted under 35 U.S.C. 154(b) by 0 days.

(21) Appl. No.: 10/978,820

(22) Filed: Nov. 2, 2004

(51) Int. Cl.
*H04R 25/00* (2006.01)

(52) U.S. Cl. ..... 381/375; 381/374; 381/381

(58) Field of Classification Search ..... 381/716, 381/74, 370, 371, 374, 375, 379, 380, 381, 381/330; 379/430, 431; 455/575.2, 569.1, 455/569.2; 181/128, 129, 135
See application file for complete search history.

(56) References Cited

U.S. PATENT DOCUMENTS

| | | | | |
|---|---|---|---|---|
| D266,244 | S | 9/1982 | Hofer et al. | |
| 6,101,260 | A * | 8/2000 | Jensen et al. | 381/381 |
| D443,871 | S | 6/2001 | Hofstede et al. | |
| D447,743 | S | 9/2001 | Ma | |
| D451,493 | S | 12/2001 | Ng | |
| D460,436 | S | 7/2002 | Bjorklund et al. | |
| D460,960 | S | 7/2002 | Kao | |
| D461,791 | S | 8/2002 | Ma | |
| D468,728 | S | 1/2003 | Rath et al. | |
| D471,889 | S | 3/2003 | Rath et al. | |
| D475,698 | S | 6/2003 | Rath et al. | |
| 2002/0021800 | A1 | 2/2002 | Bodley et al. | |
| 2002/0071586 | A1 | 6/2002 | Sung | |
| 2002/0110249 | A1 | 8/2002 | Jeon et al. | |
| 2003/0002704 | A1 | 1/2003 | Pronk | |
| 2003/0012396 | A1 | 1/2003 | Smith | |
| 2003/0114201 | A1 | 6/2003 | Chung et al. | |
| 2004/0028218 | A1 | 2/2004 | Rath et al. | |
| 2004/0052362 | A1 | 3/2004 | Bodley et al. | |
| 2004/0052363 | A1 | 3/2004 | Bodley et al. | |
| 2004/0052364 | A1 | 3/2004 | Bodley et al. | |

FOREIGN PATENT DOCUMENTS

| | | |
|---|---|---|
| DE | 298 08 425 U1 | 9/1998 |

* cited by examiner

*Primary Examiner*—Huyen Le
(74) *Attorney, Agent, or Firm*—Pillsbury Winthrop Shaw Pittman, LLP

(57) ABSTRACT

The present application discloses a headset with a resiliently deflectable boom.

7 Claims, 4 Drawing Sheets

HEADSET WITH RESILIENTLY DEFLECTABLE BOOM

FIELD OF THE INVENTION

The present invention relates to a headset, and more particularly to a headset of the type having a microphone boom that pivots between a folded storage position and an extended operative position.

BACKGROUND OF THE INVENTION

U.S. Patent Application No. 2002/0110249 A1, the entirety of which is incorporated herein, discloses a headset wherein the microphone boom detaches when its pivotal connection is subject an excessive amount of force. This is an undesirable construction, because electrical contacts are placed at the points where the boom pivotally connects, adding complexity and expense to the design. Also, it is undesirable to allow the boom to be separated from the headset's main body, as that presents the risk of the user losing the boom, and needing to buy a new headset or replacement boom. As such, the present invention endeavors to provide an improved construction for dealing with situations wherein excess force is applied to the microphone boom of a headset.

SUMMARY OF THE INVENTION

One aspect of the present invention provides a headset having an improved microphone boom. The headset comprises a main body, a speaker provided on the main body, and an earhook provided on the main body. The earhook is configured to attach the headset in an operative position to a user's ear with the speaker adjacent the user's ear. A boom has a proximal end portion and a distal end portion. The proximal end portion is pivotally connected to the main body to enable the boom to be moved between (a) a folded storage position wherein the boom is disposed generally alongside the main body, and (b) an extended operative position wherein the boom extends away from the main body so that, when the headset is attached in the operative position to the user's ear, the distal end portion is held out forwardly towards a mouth of the user. A microphone is carried on the distal end portion of the boom. Circuitry is provided in the main body for transmitting and receiving signals between the microphone, the speaker, and a communications device. The boom has at least a portion thereof that is resiliently deflectable. When the boom is in the extended position and a force is applied thereto, the resiliently deflectable portion enables the boom to resiliently flex so as to absorb at least a portion of the force and reduce a transmission of the force to the pivotal connection between the distal end portion and the main body.

Other aspects, features and advantages of the present invention will become apparent from the following detailed description, the accompanying drawings, and the appended claims.

DETAILED DESCRIPTION OF THE ILLUSTRATED EMBODIMENT OF THE INVENTION

Figure 1:
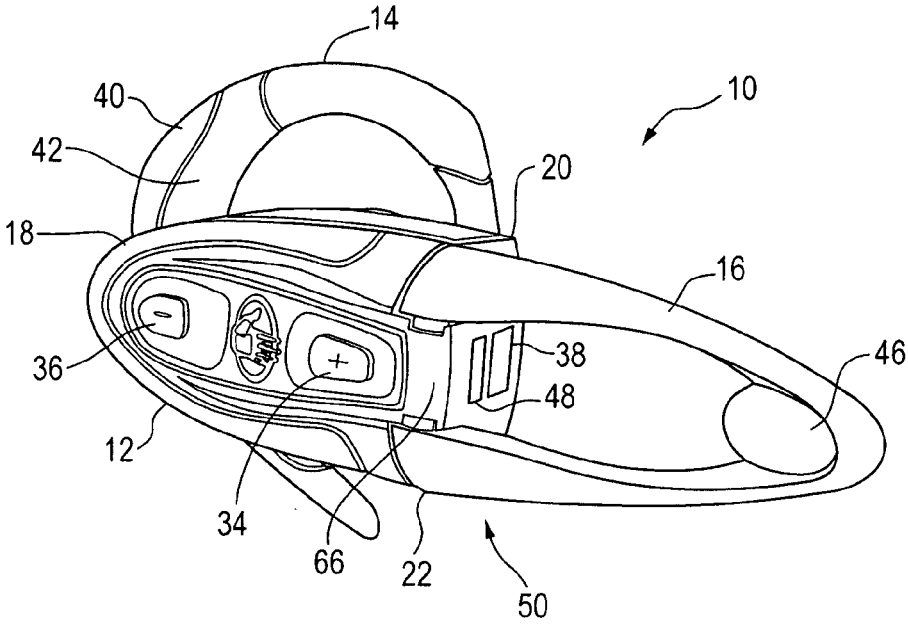
FIG. 1 is a front perspective view of a headset taken from the outer side thereof.

The Figures illustrate one example of a headset, generally indicated at 10, constructed in accordance with the present invention. The illustrated headset 10 is of the wireless type that communicates without the use of a wired connection to a communication device, such as a wireless telephone, PDA or any other device capable of being used for communicating data or voice signals. Such a wireless connection may be accomplished using the BLUETOOTH™ protocol, or any other suitable protocol. Of course, the present invention could be applied to traditional wired headsets that connect to a communication device using a pair of wires and a jack that plugs into a corresponding socket on a communications device. The illustrated headset is only an example and its construction should not be considered limiting in any way.

The headset 10 comprises a main body 12, an earhook 14, and a microphone boom 16. As will be discussed, a speaker is provided on the main body 12 and a microphone is provided on the boom 16. Neither of these structures are shown, but their construction is well known and any suitable speaker or microphone may be used. Also, circuitry is provided for transmitting, receiving and processing signals between the microphone, the speaker, and the communications device. Such circuitry is known in the art and need not be detailed herein. Any suitable circuitry for establishing such communication may be used. As mentioned above, this circuitry may operate on the BLUETOOTH™ protocol or any other wireless protocol, and likewise may be of the more conventional type where a pair of wires are used to connect the circuitry in the headset to the communications device.

Turning first to the main body 12, the main body 12 includes a housing 18 with two molded plastic halves 20, 22 that are attached together in any suitable manner, such as by fasteners, glue, heat staking, snap-fitting, or otherwise. The inner housing half 20 (called inner as it will face inwardly towards the user's head when the headset is worn in an operative position) has a circular opening in which a speaker housing 24 is received. The speaker is not shown, but is received in this housing 24, and this housing 24 has openings 26 through which the speaker can deliver audible signals to the wearer's ear. The speaker housing 24 presents a peripheral flange 28 that is spaced from the housing 18, which provides a space in which a mounting portion 30 of the earhook 14 is received.

The housing 18 also has openings formed therein through which functional elements connected to the circuitry (not shown) inside the housing 18 are presented to the exterior of the housing 18. For example, an on/off switch 32 may be provided for activating/deactivating the circuitry in the headset 10. This is desirable in wireless headsets, which contain batteries, because power cannot be drawn from the communications device with which the headset is being used to drive its circuitry. Likewise, a volume up button 34 and a volume down button 36 (or a knob or dual direction button) may be provided for controlling the headset circuitry to raise or lower the volume output from the speaker. Also, a USB port 38 may be provided for connecting the headset's circuitry to a computer, such as a laptop computer or a handheld computer (such as those made by PALM and SONY). This feature would enable the headset 10 to act as a dongle that establishes a connection between the computer and a communications device, such as a wireless telephone. The user can then use this arrangement to dial into an ISP and access the Internet or computer networks much in the way computers conventionally do via hard wire telephones. None of these features are essential, and are only preferred features of the illustrated embodiment. The circuitry in the headset 10 may be of any type and need only enable the speaker and microphone to transmit and receive signals to and from the communications device.

The main body 12 may generally have any suitable construction or configuration and the one illustrated should not be regarded as limiting.

Turning next to the earhook 14, the earhook 14 has the mounting portion 30 mentioned above and an ear engaging portion 40. The mounting portion 30 has a general C-shape and snaps over the speaker housing 24 so as to be rotatably received in the space defined between the housing 18 and the flange 28 of the speaker housing 24. This enables the positioning of the main body 12 to be rotatably adjusted relative to the earhook 14 for adjusting the positioning of the microphone boom 16 and the microphone carried by it. Also, the mounting portion 30 may be made of a resiliently flexible material to enable it to be removed from the speaker housing 24 and installed in a reverse manner. This would enable a user to wear the headset on his/her opposite ear (as shown, the headset is configured to be worn on the user's right ear, and would be flipped 180 degrees to be worn on a user's left ear). Further, the ear engaging portion 40 has a hook-shape designed to fit over a wearer's ear in the space between the ear's auricle (also called the pinna) and the wearer's head. The ear engaging portion 40 is preferably made of a resilient material that enables it to deflect and comfortably conform to the wearer's ear. Also, the ear engaging portion 40 may be provided with a soft rubber or foam overmold 42 in the area contacting the wearer's ear for providing additional comfort.

The earhook 14 generally functions to attach the headset 10 in an operative position to a user's ear with the speaker adjacent and facing the user's ear. This enables the speaker to deliver audible signals to the wearer's ear. The illustrated construction of the earhook 14, however, is only exemplary and should not be considered limiting. To the contrary, the earhook 14 may have any construction or configuration.

Turning next to the boom 16, the boom 16 has a microphone housing 44 at its distal end portion 46 and a hinge rod 48 at its proximal end portion 50. The microphone housing 44 is cup-shaped and has a space in which the microphone is received. The microphone housing 44 is preferably molded from a rigid plastic material, such as ABS, and has proximal and distal ports 52 and 54, respectively, for permitting sound to enter therein.

The boom 16 also includes an internal structure in the form of a backbone 56 formed from a relatively rigid material, such as Acetal (POM) or any other suitable material. The backbone 56 is constituted by two main parts. The first part is a lower leg 60 that is integrally molded with the hinge rod 48. The hinge rod 48 is provided at its upper end with a hollow interior. The second part is an upper leg 62 that has a projection (not shown) integrally molded therewith. This projection is removably received in the hollow interior on the upper end of the hinge rod 48 for purposes that will be discussed below. The legs 60, 62 are tapered towards their distal end so as to improve their flexibility and reduce their effective rigidity towards their distal ends. These legs 60, 62 preferably extend for a substantial length of the boom 16, and preferably for over half its length. Optional indentations 63 are formed into the legs 60, 62 along their length to increase flexibility.

The boom also includes an external overmolded structure in the form of overmold 64 formed of a somewhat less rigid material, such as Kraton or any other suitable material. That is, the internal structure of each leg is formed from a material having a substantially higher Young's modulus than a material from which the external overmolded structure is formed. The overmold 64 is formed in a mold over the legs 60, 62 and the microphone housing 44. The overmold closes the microphone housing 44 and preferably encapsulates the legs 60, 62 entirely.

Figure 2:
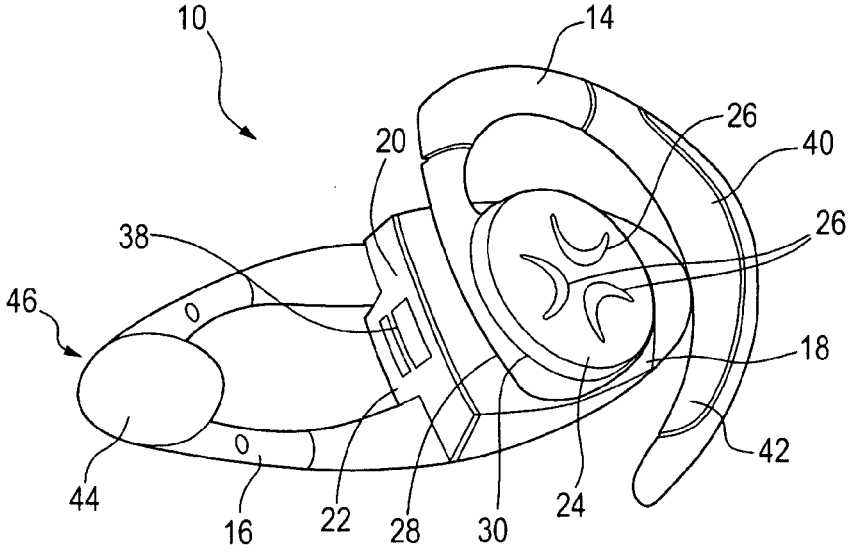
FIG. 2 is a front perspective view of the headset of FIG. 1, taken from the inner side thereof.
Figure 3:
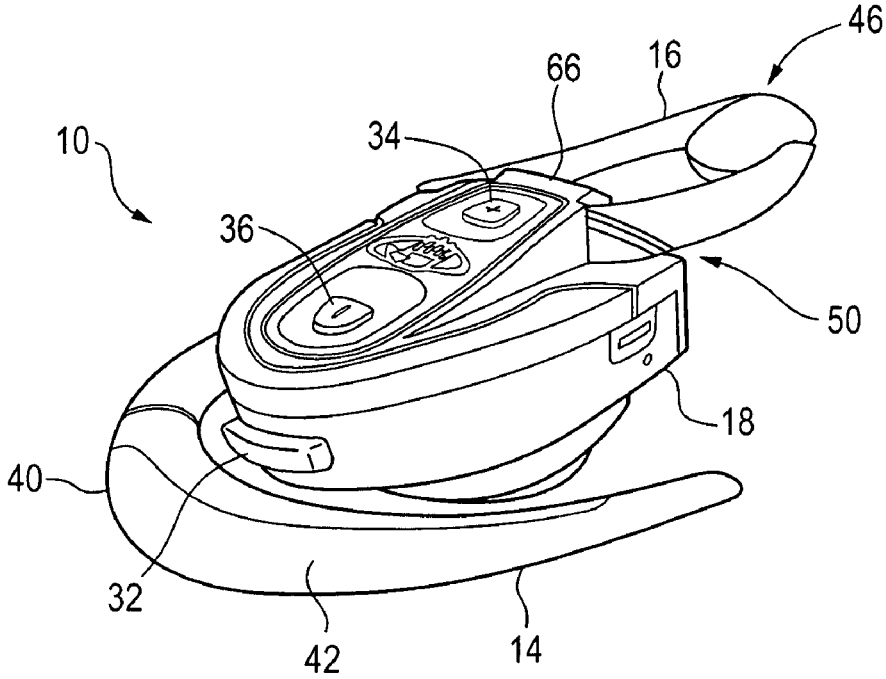
FIG. 3 is a rear perspective view of the headset of FIG. 1, taken from the outer side thereof.
Figure 4C:
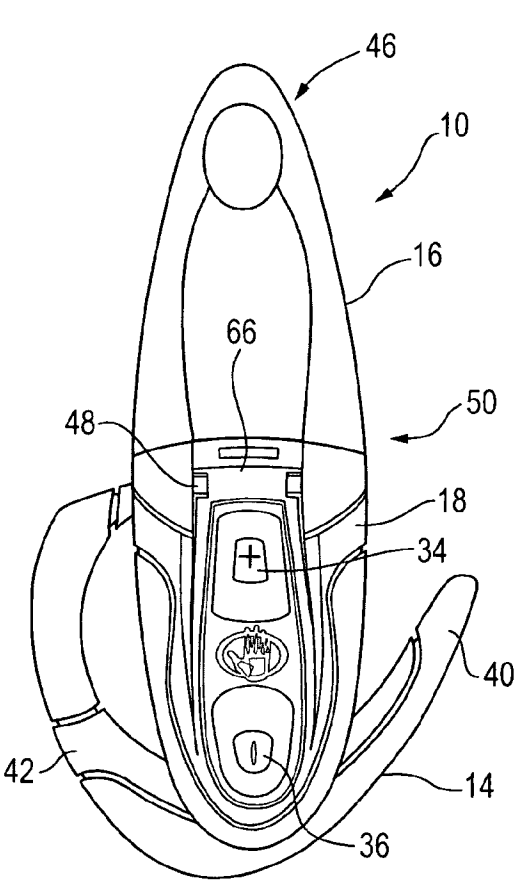
FIG. 4C is an outer side profile view of the headset of FIG. 1.
Figure 4B:
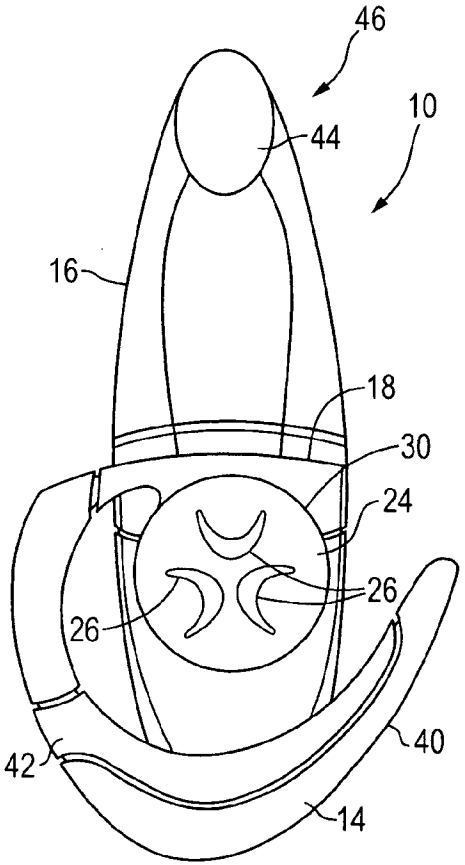
FIG. 4B is an inner side profile view of the headset of FIG. 1.
Figure 4A:
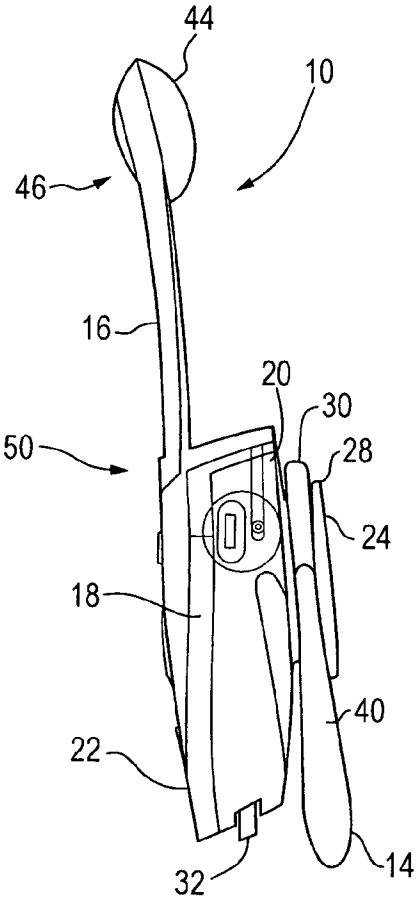
FIG. 4A is a bottom plan view of the headset of FIG. 1.
Figure 5:
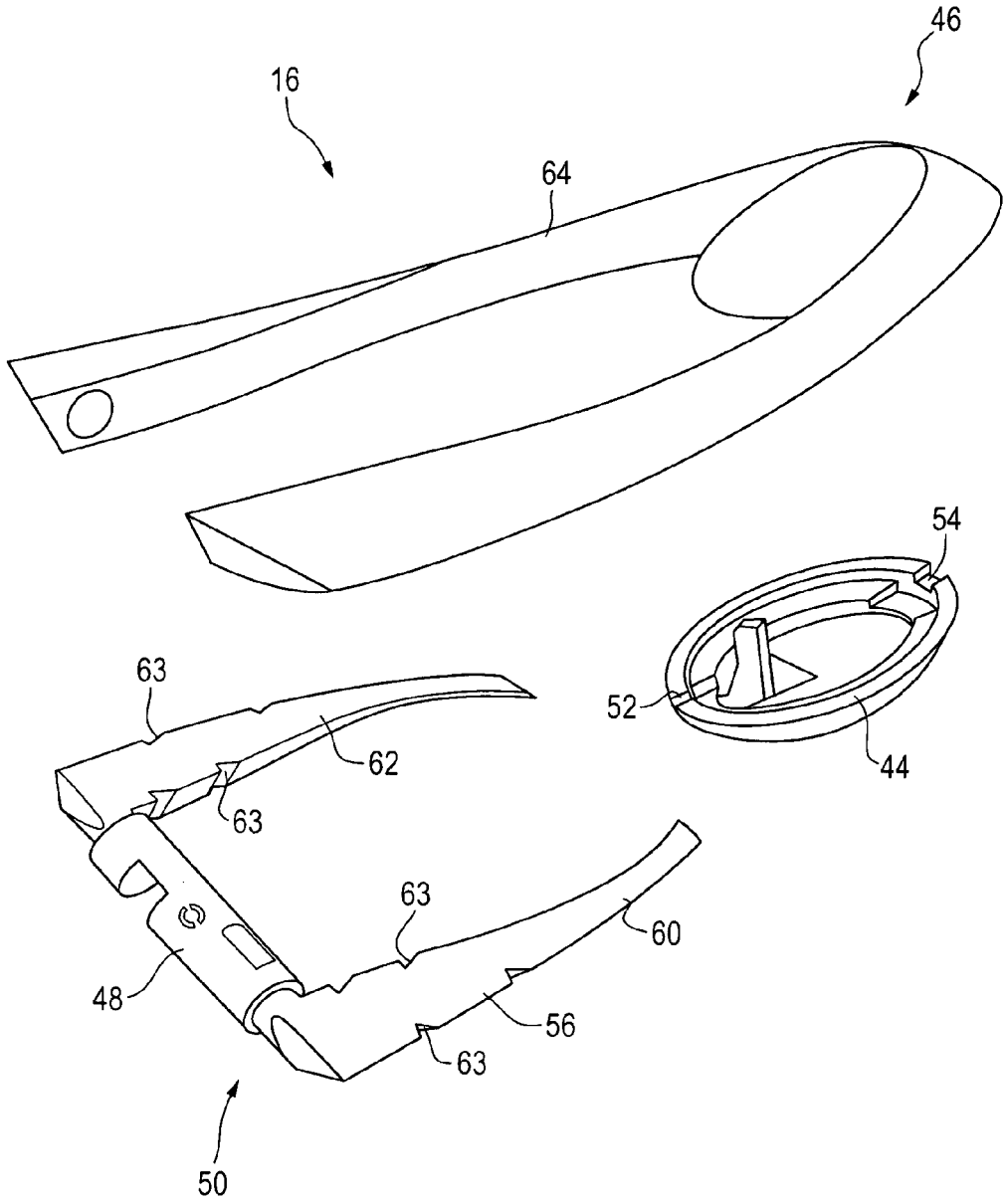
FIG. 5 is an exploded perspective view of the boom used in the headset of FIG. 1.

The boom 16 is connected to the main body 12 by a hinge receptacle 66 formed on the housing 18. Specifically, the projection discussed above on the upper leg 60 can be pulled out of the hollow interior on the hinge rod 48. Then, the hinge rod 48 can be inserted in the hinge receptacle 66, and the projection can be inserted back into the hollow interior of the hinge rod 48. This pivotally connects the boom 16 to the main body 12. The boom can be pivoted between (a) a folded storage position wherein the boom 16 is disposed generally alongside the main body 12, and (b) an extended operative position wherein the boom 16 extends away from the main body 12 so that, when the headset 10 is attached in the operative position to the user's ear, the distal end portion 46 with the microphone is held out forwardly towards a mouth of the user. That is, the boom can be pivoted in an opening direction from the storage to the extended position, and in a closing direction from the extended position back to the storage position. The extended operative position is shown in FIGS. 1–4C. In the storage position, the headset can easily be carried in user's pocket or mounted on a belt clip or belt mounted holster.

Preferably, the material selection and configuration of the boom 16 renders the boom 16 resiliently deflectable. As can be seen from the Figures, the headset 10 is constructed such that the boom cannot pivot past the extended operative position. Any force that is applied to keep moving the boom 16 in that direction will cause the legs 60, 62 to act as levers transmitting the force to the hinge rod 48. By making the boom 16, and particularly the legs 60, 62 thereof, resiliently deflectable, the boom 16 itself absorbs such a force applied to it and reduces the amount of force transmitted to the hinge rod 48. This behavior is desirable because while wearing the headset the user may incidentally strike the distal end portion 46 against an object, or may sit on the headset if he/she accidentally places the headset 10 on a chair while the boom is in the extended operative position. An effective Young's modulus or bending resistance of the boom 16 may be varied as desired to allow for the desired amount of "give" or deflection based on the length of the boom 16. Of course, the boom 16 should not be so flexible that it cannot support the microphone and its housing 44, or deflects noticeably under the weight of the microphone. Instead, the boom 16 should behave resiliently such that upon removal of such a force, the boom 16 will return to its original configuration, (i.e., it will experience essentially no plastic deformation).

The numerical ranges and values provided above should not be considered limiting, and any suitable range may be used for providing the boom 16 with a suitable resiliency for deflecting to absorb force and reduce their transmission to the pivotal connection of the boom 16. Further, the illustrated construction for the boom 16 is only an example and should not be considered limiting. Any other suitable construction may be used, with additional materials, or only a single material. The illustrated construction is considered desirable because it provides the boom 16 with more structural rigidity closer to its proximal end portion 50 at the main body 12, where its connection is made, but with increased resiliency towards the distal end portion 46 where it can resiliently flex.

The foregoing illustrated embodiment has been provided solely to illustrate the structural and functional principles of the present invention and is not intended to be limiting. To the contrary, the present invention is intended to encompass all alterations, substitutions, and equivalents within the spirit and scope of the following claims.

What is claimed is:

1. A headset comprising:

a main body;

a speaker provided on the main body;

an earhook provided on the main body, the earhook being configured to attach the headset in an operative position to a user's ear with the speaker adjacent the user's ear;

a boom having a proximal end portion and a distal end portion, the proximal end portion being pivotally connected to the main body to enable the boom to be pivoted in an opening direction from (a) a folded storage position wherein the boom is disposed generally alongside the main body, to (b) an extended operative position wherein the boom extends away from the main body so that, when the headset is attached in the operative position to the user's ear, the distal end portion is held out forwardly towards a mouth of the user;

a microphone carried on the distal end portion of the boom;

circuitry provided in the main body for transmitting and receiving signals between the microphone, the speaker, and a communications device;

the boom having at least a portion thereof between its proximal and distal end portions that is a resiliently deflectable to enable the boom to resiliently flex in the opening direction without pivoting further in the opening direction when in the extended position and a force is applied thereto so as to absorb at least a portion of the force and reduce a transmission of the force to the pivotal connection between the distal end portion and the main body.

2. A headset according to claim 1, wherein the boom has two spaced apart legs extending between the distal and proximal end portions thereof.

3. A headset according to claim 2, wherein each leg includes an internal structure and an external overmolded structure.

4. A headset according to claim 3, wherein the internal structure of each leg extends from the pivotal connection of the boom and tapers toward the distal end portion of the boom.

5. A headset according to claim 4, wherein the internal structure of each leg is formed from a material having a substantially higher Young's modulus than a material from which the external overmolded structure is formed.

6. A headset comprising:

a main body;

a speaker provided on the main body;

an earhook provided on the main body, the earhook being configured to attach the headset in an operative position to a user's ear with the speaker adjacent the user's ear;

a boom having a proximal end portion and a distal end portion, the proximal end portion being pivotally connected to the main body to enable the boom to be moved between (a) a folded storage position wherein the boom is disposed generally alongside the main body, and (b) an extended operative position wherein the boom extends away from the main body so that, when the headset is attached in the operative position to the user's ear, the distal end portion is held out forwardly towards a mouth of the user;

a microphone carried on the distal end portion of the boom;

circuitry provided in the main body for transmitting and receiving signals between the microphone, the speaker, and a communications device;

the boom having at least a portion thereof that is a resiliently deflectable to enable the boom to resiliently flex when in the extended position and a force is applied thereto so as to absorb at least a portion of the force and reduce a transmission of the force to the pivotal connection between the distal end portion and the main body;

wherein the boom has two spaced apart legs extending between the distal and proximal end portions thereof;

wherein each leg includes an internal structure and an external overmolded structure; and wherein the internal structure of each leg extends from the pivotal connection of the boom and tapers toward the distal end portion of the boom.

7. A headset according to claim 6, wherein the internal structure of each leg is formed from a material having a substantially higher Young's modulus than a material from which the external overmolded structure is formed.

* * * * *